United States Patent [19]

Cohen

[11] 4,320,542

[45] Mar. 23, 1982

[54] PORTABLE, SUSPENDED OUTDOOR SHELTER

[76] Inventor: Howard Cohen, 2001 Lincoln St., Berkeley, Calif. 94709

[21] Appl. No.: 153,745

[22] Filed: May 27, 1980

[51] Int. Cl.[3] ..... A45F 1/06; A45F 3/22

[52] U.S. Cl. ..... 5/121; 5/128

[58] Field of Search ..... 5/121, 120, 127, 128, 5/130; D6/53; 297/277

[56] References Cited

U.S. PATENT DOCUMENTS

| | | | |
|---|---|---|---|
| 363,096 | 5/1887 | Travers | 5/121 X |
| 1,081,481 | 12/1913 | Avery et al. | 5/121 |
| 1,150,008 | 8/1915 | Ampt | 5/120 X |
| 1,156,200 | 10/1915 | Ashworth | 5/121 |
| 1,401,846 | 12/1921 | Wiles | 5/121 |
| 2,375,792 | 5/1945 | Kearny | 5/121 |
| 3,929,145 | 12/1975 | Schroeder | 5/128 X |
| 4,057,859 | 11/1977 | Setterholm | 5/121 |
| 4,071,917 | 2/1978 | Mojica | 5/121 |

*Primary Examiner*—Stephen J. Novosad

[57] ABSTRACT

A portable, suspended outdoor shelter includes a base panel having a pair of stiffening members secured in a pair of sleeves disposed along opposed longitudinally extending sides of the base panel. A pair of reinforcing web members extend along and reinforce the sleeves, and extend substantially therebeyond to be secured to a pair of spaced apart support structures such as adjacent tree trunks or boughs. A plurality of resilient, linear tubular members are bent in inverted U configuration and are secured above and between the stiffening members to apply tension laterally to said base panel. End panels extend between the ends of the base panel and the lower portions of their respective reinforcing web members, with a window and a door disposed in the end panels. A canopy extends between the upper edges of the end panels, and is supported by the inverted U tubular members. The base and end panels and canopy define an enclosed shelter which is suspended above the ground between two trees or the like, and is secure from the elements, and ground-dwelling creatures.

14 Claims, 8 Drawing Figures

PORTABLE, SUSPENDED OUTDOOR SHELTER

BACKGROUND OF THE INVENTION

In recent years there have been great improvements in portable, lightweight outdoor shelters, and in particular tents designed for backpacking and overnight camping. The advent of synthetic fabrics and coatings therefore, lightweight aluminum support poles, resilient fiberglass poles, and streamlined designs has resulted in a proliferation of moderately priced tents which are not only reasonably secure from rain and wind, but also are roomy and comfortable.

Despite these improvements in modern tents, they still suffer from drawbacks which are seemingly inherent in tents themselves. For example, the sleeping comfort of a tent is entirely dependent on the terrain on which the tent rests. In hilly, sloping, rocky, or bumpy areas, sleeping in a tent can be an unpleasant experience, since cots or beds are impractical for most camping and all backpacking.

Likewise, the ability of tents to resist the intrusion of water is limited. Tents are generally designed to resist direct precipitation, but this is not the only source of water intrusion. Often a sudden deluge will precipitate at a rate far in excess of the runoff and absorption capacity of the terrain. In such circumstances the precipitation will collect as standing water. This standing water easily may penetrate seams and small holes in the tent fabric, as well as door and window openings in the tent.

Also, sleeping in a tent is in essence sleeping on the ground, and as such it invites confrontations with ground dwelling creatures. Animals such as snakes, spiders, ticks, rodents, and their fleas, and the like pose a real threat to an individual on the ground, no matter how kindly his or her disposition toward creatures of the animal kingdom. Indeed, many persons are reluctant to try camping or backpacking, due to this fear of vulnerability to ground dwelling creatures.

SUMMARY OF THE PRESENT INVENTION

The present invention generally comprises a portable outdoor shelter which overcomes the problems associated with prior art shelters supported on the ground, such as water leakage, ground dwelling creatures, dust and dirt, and the like. The shelter of the present invention overcomes these problems by providing a structure which is suspended above the ground between extant, spaced apart supporting structures, such as trees, vehicles, posts, and the like. It provides a firm, resilient sleeping surface which is spaced above and isolated from ground dwelling animals and insects, moisture in the earth, and the like. The structure also includes a canopy which is selectively closeable to repel precipitation and insects, as well as opposed end panels having screened door and window portions.

The portable shelter is constructed of a fabric base panel having a pair of longitudinally extending, opposed sides provided with a pair of pole sleeves extending therealong. A pair of extended reinforcing web members are provided, each one sewn into and longitudinally extending through one of the pole sleeves. Like ends of the pair of reinforcing web members extend substantially beyond the ends of the base panel, and are joined and secured to spaced support structures.

A pair of relatively rigid side pole assemblies are secured within the pole sleeves to provide stiffness in the base panel along the longitudinal extent thereof. A plurality of linear, resilient tubular members, such as fiberglass pole assemblies, are bent into inverted U configurations and coupled between the side pole assemblies in spaced apart fashion therealong. The restoring force of the resilient members in the bent configuration urges the base panel laterally outwardly and applies lateral tension in longitudinally distributed fashion to the base panel. The base panel, which includes transverse reinforcing web portions to accommodate the lateral tension, is pulled taut by the lateral tension to form a resilient yet firm sleeping surface.

A top member extends over the resilient tubular members, and is supported thereby in canopy fashion. The top member may be provided with transversely extending sleeves through which the resilient tubular members extend. One longitudinal edge of the top member may be joined to a like edge of the base panel, while the other side edge of the top is releasably secured to the respective edge of the base panel. The free edge of the top member may be slid upwardly and furled along the resilient tubular members to open the shelter to fair weather.

The shelter also includes end assemblies secured to opposed ends of the base panel and extending obliquely upwardly therefrom. The end assemblies may be supported by resilient tubular members secured thereto, or may be supported between the reinforcing web members extending obliquely upwardly from the respective end of the base panel. The end assemblies include screened door and window portions which face obliquely downward and provide ventilation during even the most severe downpour.

It should be noted that the shelter construction of the present invention overcomes the deficiencies in the prior art noted in the foregoing discussion; that is, it provides a shelter in which sleeping comfort is no longer dependent on the vicissitudes of the terrain, and it also provides separation and isolation from ground-dwelling creatures and the like.

A BRIEF DESCRIPTION OF THE DRAWING

DESCRIPTION OF THE PREFERRED EMBODIMENT

Figure 1:
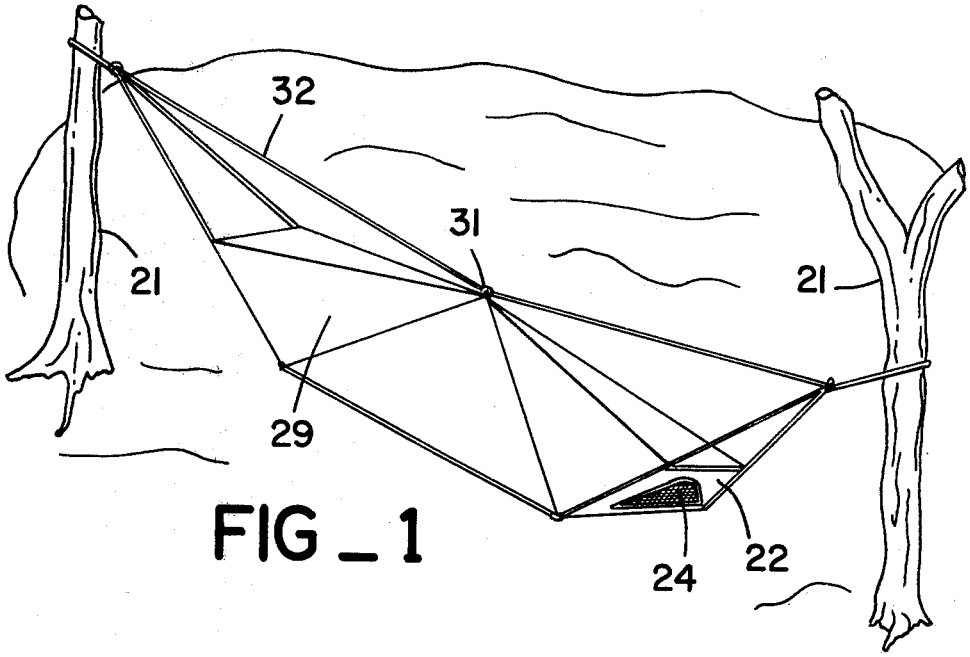
FIG. 1 is a perspective view of one embodiment of the portable shelter of the present invention.
Figure 2:
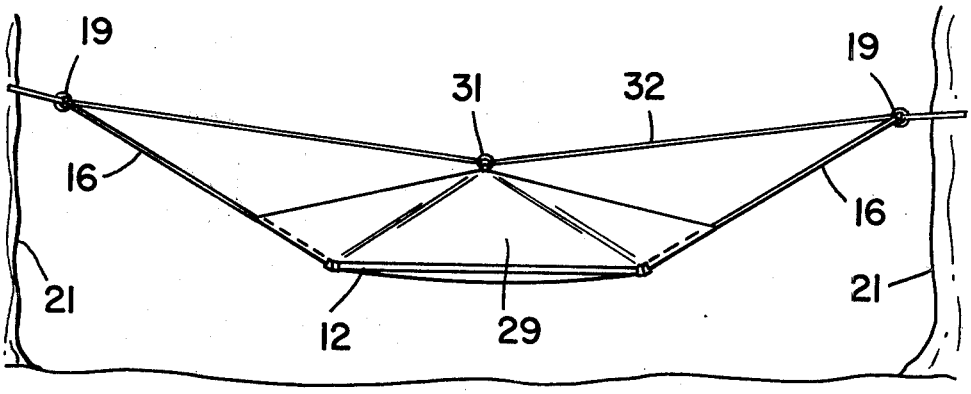
FIG. 2 is a side elevation of the embodiment of the portable shelter shown in FIG. 1.
Figure 3:
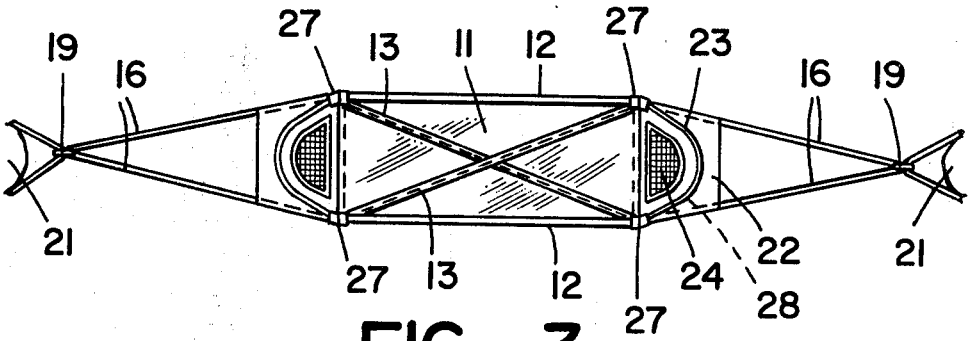
FIG. 3 is a bottom view of the portable shelter as shown in FIGS. 1 and 2.
Figure 7:
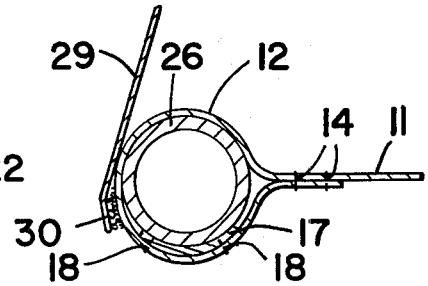
FIG. 7 is an enlarged cross-sectional detail view of a side pole assembly of the present invention.

The present invention generally comprises a portable outdoor shelter which is designed to be spaced above the ground and suspended between existing spaced apart supporting structures, such as trees, vehicles, walls, posts, or the like. The shelter is thus removed from ground dwelling creatures and ground moisture, and provides a resilient bed in a protected enclosure. As shown in FIGS. 1-3, one embodiment of the invention includes a base panel 11, rectangular in configuration, formed of a durable, high strength fabric such as nylon duck or the like. A pair of parallel pole sleeves 12 are formed in the longitudinally extending sides of the base panel by folding the edge portions back on themselves and sewing together the confronting portions with a seam or seams 14 spaced inwardly from the fold line as shown in FIG. 7. A pair of reinforcing web members 13 (nylon webbing or the like) is sewn to the base panel, each extending between diagonally opposed corners thereof.

The shelter also includes a pair of longitudinally extending web members 16 formed of nylon webbing or material equivalent in strength. The medial portions 17 of the web members 16 extend entirely through respective pole sleeves 12, and are secured therein by longitudinal seams 18. The web members may be prestressed under tension while the seams 18 are being formed to accommodate the elasticity of the web material under tensile loading. The distal ends of the web members 16 are joined at like ends to extend through a respective one of a pair of rings 19. The rings 19 are tied or otherwise tightly secured to a pair of spaced apart, existing support structures 21, such as three trunks or boughs, vehicles, posts or poles, retaining rings, brackets, or the like. The web members thus serve to suspend the base panel and indeed the entire shelter, at opposed ends thereof.

A pair of end assemblies 22 are also provided, each being a regular trapezoid in configuration and constructed of waterproof fabric. Each end assembly has one parallel edge secured to one end of the base panel 12, and opposed tapering edges joined to respective proximal portions of the longitudinal web members 16, as shown in FIG. 3. Each end assembly includes an arcuate pole sleeve 23 formed therein, the ends of the sleeve 23 intersecting the vertices of the longer parallel edge. Within the concavity of the pole sleeve 23 is disposed a half-oval window 24, including an insect-netting portion and a resealable fabric panel to occlude the window 24 when desired. In one end assembly the netting portion is adapted to be openable by use of zipper or hook and loop fabric fasteners, so that entrance or egress to the shelter may be obtained.

Disposed within the longitudinal pole sleeves 12 are a pair of rigid pole assemblies 26. The pole assemblies may be formed of mutually engaging socket-ended segments of lightweight tubular or channel stock, the segments being easily joined or disassembled to facilitate erection of the shelter and portability of components for traveling. The pole assemblies 26 exhibit great rigidity, and are provided to resist longitudinal bowing and sagging of the suspended base panel when supporting the weight of one or two individuals in repose thereon.

A quartet of coupling members 27 are secured to the ends of the pole assemblies 26 directly adjacent to the open ends of the pole sleeves 12. A pair of pole assemblies 28 are disposed in the sleeves 23 of the end assemblies 22, the ends of each pole assembly 28 being secured to a laterally opposed pair of coupling members 27. Each pole assembly 28 may also be formed by mutually engaging socket-ended segments of linear tubular or channel stock. However, the pole assemblies 28 are constructed of a material such as fiberglass, capable of being bent elastically from its natural linear form into the inverted U configuration of the sleeves 23. The restoring force of the pole assemblies 28 is transmitted through the coupling members 27 to the pole assemblies 26, urging them laterally ourwardly each away from the other. The lateral outward movement of the pole assemblies 26 is limited by the lateral extent of the base panel 12, so that the base panel is placed under tension and held taut by the restoring force of the pole assemblies 28. As a result, the base panel firmly supports one or two individuals sleeping or reposing thereon.

The shelter of the present invention also includes a canopy 29 extending continuously between the end assemblies 22 in the longitudinal direction, and arching in the lateral direction between the pole sleeves 12. A ring 31 is secured to a medial portion of the canopy, and a guy line 32 stretched taut between the supporting structures 21 is passed through the ring 31 to support the canopy spaced above the base panel. The canopy is constructed of a waterproof, lightweight material, and forms an enclosed shelter, in conjunction with the end assemblies and the base panel. The shelter is provided with ample cross-ventilation through the windows 24, yet it is completely waterproof. It should be noted that the windows 24 face obliquely downwardly, and thus may be opened for ventilation during periods of rain without admitting the precipitation into the shelter.

Figure 4:
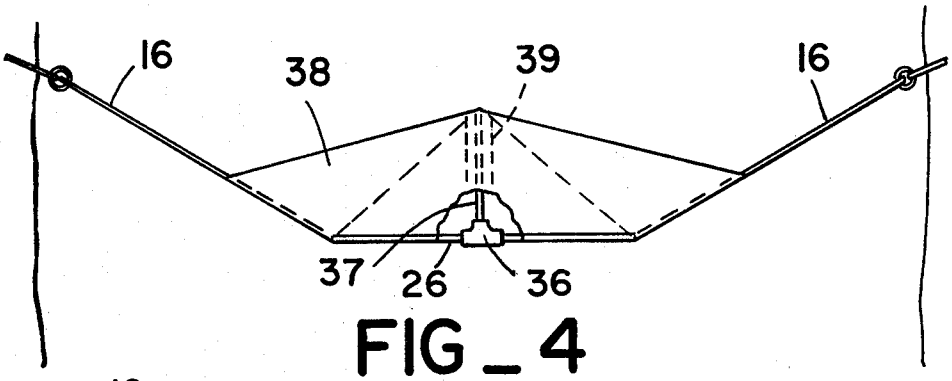
FIG. 4 is a partially cutaway side elevation of a further embodiment of the portable shelter of the present invention.
Figure 5:
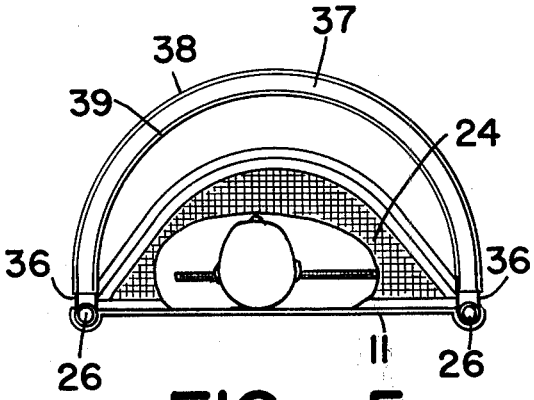
FIG. 5 is a vertical cross-sectional view of the embodiment shown in FIG. 4.

With reference to FIG. 4, an alternative embodiment of the present invention includes similar end assemblies 22, base panel 11, and pole sleeves 12 housing pole sets 26. Each pole sleeve 12 is provided with a cutout positioned medially with respect to the longitudinal extent thereof. A T connector 36 is secured to the medial portion of each pole set 26, with the stem of the connector extending upwardly through the cutout. A linear, resilient pole assembly 37 is bent into an inverted U form and secured to the stems of the T connectors 36, as shown in FIG. 5. The elastic restoring force of the pole assembly 37 exerts a force laterally outwardly on the medial portion of the pole assemblies 26, stretching taut the medial portion of the base panel 11. The pole assembly 37, in conjunction with the pole assemblies 28 in the end assemblies, aids in maintaining the base panel firm and taut to support one or more individuals thereon.

In the embodiment of FIGS. 4 and 5, a canopy 38 extends between the end assemblies and over the pole assembly 37. The canopy 38 may be provided with a laterally extending sleeve 39 through which the pole assembly 37 extends. The assembly 39 thus supports the medial portion of the canopy, while tension in the canopy provides longitudinal stability to the pole assembly 37. As in the previous embodiment, one longitudinal edge and both end edges may be secured to the base panel and the end assemblies, respectively, by hook and loop fastener means 30, so that the canopy may be openable when flying insects or inclement weather pose no problems.

Figure 8:
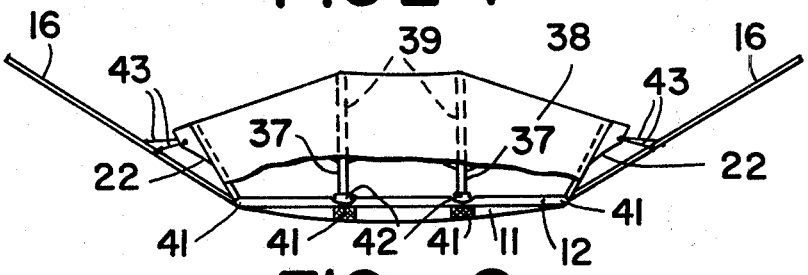
FIG. 8 is a side elevation of a further embodiment of the portable shelter of the present invention.

In a further embodiment of the present invention, shown in FIG. 8, the base panel 11 is provided with a plurality of laterally extending reinforcing webs 41 spaced longitudinally therealong. Pole sleeves 12 are provided as before, and a plurality of cutouts 42 are formed in the sleeves 12, each cutout 42 disposed directly adjacent to an end of a web 41. A like plurality of T connectors 36 are provided, as in the previous embodiment, and secured to the pole assemblies 26 in the sleeves 12 with the stem of each connector extending upwardly through a cutout. A plurality of inverted, U shaped, resilient pole assemblies 37 are secured to the laterally opposed T connectors 36, also as in the embodiment described previously. The outward restoring force of the bent pole assemblies 37 applies tension to the base panel 11, and this tension is applied at longitudinally spaced intervals. It may be appreciated that the laterally extending reinforcing webs 41 prevent stretching of the base panel under the tension applied by the pole assemblies 37.

Figure 6:
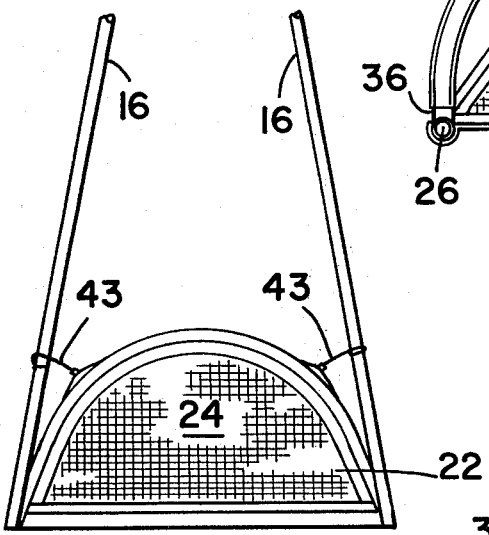
FIG. 6 is an end elevation of another embodiment of the end assembly of the present invention.

In the embodiment shown in FIG. 8, the end assemblies 22 are substantially the same as in previous embodiments. The major distinction, however, is that the end assemblies are not directly secured to the longitudinal web members 16. Rather, paired tie lines 43 extend from each end assembly to their respective adjacent web members 16 as shown also in FIG. 6, and are secured thereto with slip rings. This end assembly construction permits greater flexure of the structure without causing undue stress to the components thereof. Also, this construction is more tolerant of a wide range of angular positions of the webs 16, so that the spacing of the supporting structures is not critical.

A canopy 38 is provided, as in the previous embodiment, and is supported by the plurality of pole assemblies 37 as well as by the end assemblies to which it is secured. As before, the pole assemblies 37 may be received in sleeves extending laterally in the canopy. With one longitudinal edge of the canopy and both end edges secured to the shelter by releasable fastening means, the canopy may be slid upwardly along the pole assemblies and furled to open the shelter in fair weather. The multiple pole assemblies 37 maintain greater spacing of the canopy from the base panel, thus creating more interior space in the shelter. The multiple pole assemblies 37 also apply more lateral tension to the base panel in a distributed fashion, so that more weight may be supported on the base panel without causing undue bowing or sagging thereof.

I claim:

1. A suspended, outdoor shelter, comprising a base panel having a pair of opposed, longitudinally extending edges; a pair of first sleeves formed in said base panel, each extending along one of said longitudinally extending edges; a pair of web members extending longitudinally, the medial portion of each secured to one of said edges of said base panel; a pair of longitudinally extending stiffening members, each secured in one of said first sleeves; means for urging said stiffening members outwardly each away from the other; and means for securing like ends of said web members to spaced apart support structures to suspend said shelter therebetween.

2. The shelter of claim 1, further including a pair of opposed end assemblies secured to said base panel and extending upwardly between like ends of said edges.

3. The shelter of claim 2, further including a canopy extending between said opposed end assemblies and said opposed edges of said base panel; said canopy, base panel, and end assemblies defining an enclosed shelter.

4. The shelter of claims 1 or 3, wherein said means for urging said stiffening members outwardly includes a plurality of linear, resilient members bent in inverted U configuration and secured at opposite ends between said pair of stiffening members, the restoring force of said resilient members urging said stiffening members laterally each away from the other.

5. The shelter of claim 4, further including connector means for joining the ends of said resilient members and said stiffening members.

6. The shelter of claim 4, further including cutout means in said first sleeves through which said connector means join said ends of said resilient members.

7. The shelter of claim 4, further including means for securing one of said resilient members to each of said end assemblies.

8. The shelter of claim 2, wherein said end assemblies extend obliquely upwardly from said base panel and outwardly from each other, and means for securing said end assemblies to portions of said web members adjacent thereto.

9. The shelter of claim 2, further including window and door portions secured to said end assemblies.

10. The shelter of claim 3, further including at least one linear resilient member bent in inverted configuration and joined at opposite ends to said stiffening members, and wherein said canopy is supported by said resilient member in said inverted U configuration.

11. The shelter of claim 10, further including means for securing said resilient member to said canopy.

12. The shelter of claim 11, wherein said last mentioned means includes at least one second sleeve extending laterally in said canopy and adapted to receive said resilient member.

13. The shelter of claim 12, further including means for releasably securing said canopy to one edge of said base panel and to one of said end assemblies.

14. The shelter of claim 3, further including a guy line extending between the spaced apart support structures above said shelter and means for securing said canopy to said guy line.

* * * * *